US009023775B2

(12) United States Patent
Bertram et al.

(10) Patent No.: US 9,023,775 B2
(45) Date of Patent: May 5, 2015

(54) LUBRICATING OIL COMPOSITION

(75) Inventors: Richard D. Bertram, Witney (GB); Peter J. Dowding, Wantage (GB); Peter D. Watts, Abingdon (GB)

(73) Assignee: Infineum International Limited (GB)

( * ) Notice: Subject to any disclaimer, the term of this patent is extended or adjusted under 35 U.S.C. 154(b) by 104 days.

(21) Appl. No.: 12/245,784

(22) Filed: Oct. 6, 2008

(65) Prior Publication Data

US 2009/0093387 A1 Apr. 9, 2009

(30) Foreign Application Priority Data

Oct. 9, 2007 (EP) ..... 07118094

(51) Int. Cl.

| | |
|---|---|
| ***C10M 159/22*** | (2006.01) |
| ***C10M 105/48*** | (2006.01) |
| ***C10M 129/76*** | (2006.01) |
| ***C10M 129/54*** | (2006.01) |
| ***C10M 159/20*** | (2006.01) |

(52) U.S. Cl.

CPC ..... *C10M 129/54* (2013.01); *C10M 159/20* (2013.01); *C10M 2203/1006* (2013.01); *C10M 2207/144* (2013.01); *C10M 2207/146* (2013.01); *C10M 2207/262* (2013.01); *C10N 2210/02* (2013.01); *C10N 2230/04* (2013.01); *C10N 2230/52* (2013.01); *C10N 2240/102* (2013.01); *C10N 2270/02* (2013.01)

(58) Field of Classification Search

CPC ..... C10M 2207/027; C10M 2207/028
USPC ..... 508/460, 462, 502
See application file for complete search history.

(56) References Cited

U.S. PATENT DOCUMENTS

| | | | | |
|---|---|---|---|---|
| 4,719,023 | A * | 1/1988 | MacPhail et al. | 508/460 |
| 5,089,158 | A * | 2/1992 | Van Kruchten et al. | 508/553 |
| 5,792,735 | A | 8/1998 | Cook et al. | |
| 6,191,081 | B1 * | 2/2001 | Cartwright et al. | 508/460 |
| 6,262,001 | B1 * | 7/2001 | Le Coent et al. | 508/518 |
| 2003/0191032 | A1 * | 10/2003 | Deckman et al. | 508/460 |
| 2007/0117726 | A1 * | 5/2007 | Cartwright | 508/525 |
| 2010/0087347 | A1 * | 4/2010 | Bertram et al. | 508/460 |

FOREIGN PATENT DOCUMENTS

| | | | |
|---|---|---|---|
| EP | 1154012 | A2 | 11/2001 |
| EP | 1233053 | A1 | 8/2002 |

* cited by examiner

*Primary Examiner* — Prem C Singh
*Assistant Examiner* — Francis C Campanell

(57) ABSTRACT

A lubricating oil composition comprising a Group II basestock and a neutral or overbased metal hydrocarbyl-substituted hydroxybenzoate detergent having a basicity index of less than 2.

2 Claims, No Drawings

LUBRICATING OIL COMPOSITION

This invention relates to a lubricating oil composition. In particular, this invention relates to a lubricating oil composition that can reduce the formation of 'black paint' or "black sludge" in a marine diesel engine.

In marine trunk piston engines, Heavy Fuel Oil ('HFO') is generally used for offshore running. Heavy Fuel Oil is the heaviest fraction of petroleum distillate and comprises a complex mixture of molecules including up to 15% of asphaltenes, which are defined as the fraction of petroleum distillate which is insoluble in an excess of aliphatic hydrocarbon (e.g. heptane) but which shows solubility in aromatic solvents (e.g. toluene). Asphaltenes can enter the engine lubricant as contaminants either via the cylinder or the fuel pumps and injectors, and asphaltene precipitation can then occur, manifested in 'black paint' or 'black sludge' in the engine. The presence of such carbonaceous deposits on a piston surface can act as an insulating layer, which can result in cracks forming, which then propagate through the piston. If a crack travels right the way through, then hot combustion gases can enter the crankcase, which may result in a crankcase explosion.

A key design feature of trunk piston engine oils ('TPEO's) is prevention of asphaltene precipitation but with the current use of Group II base oils in lubricating oil compositions, their effectiveness in this respect has been reduced.

The aim of the present invention is to reduce asphaltene precipitation or 'black paint' in an engine, in particular, a marine diesel engine, lubricated with a lubricating oil composition comprising a Group II basestock.

In accordance with the present invention there is provided a lubricating oil composition comprising a Group II basestock and a neutral or overbased metal hydrocarbyl-substituted hydroxybenzoate detergent having a basicity index of less than 2.

The lubricating oil composition is preferably a trunk piston engine oil ('TPEO').

In accordance with the present invention, there is also provided a method of reducing asphaltene precipitation or 'black paint' in an engine lubricated with a lubricating oil composition comprising a Group II basestock, the method including the step of adding the neutral or overbased metal hydrocarbyl-substituted hydroxybenzoate detergent to the Group II basestock.

The engine is preferably a marine diesel engine.

By 'basicity index' we mean the molar ratio of total base to total soap in a neutral or overbased detergent. A neutral detergent has a Basicity Index of 1.0.

The basicity index is preferably less than 1.5, more preferably less than 1.2 and not less than 1.0. The basicity index is most preferably about 1.0

In accordance with the present invention there is also provided use of the lubricating oil composition to reduce asphaltene precipitation or 'black paint' in an engine.

The neutral or overbased metal hydrocarbyl-substituted hydroxybenzoate detergent is preferably a neutral or overbased calcium hydrocarbyl-substituted hydroxybenzoate detergent. The neutral or overbased metal hydrocarbyl-substituted hydroxybenzoate detergent is preferably a neutral or overbased metal salicylate detergent, and more preferably a neutral or overbased calcium salicylate detergent.

A detergent is an additive that reduces formation of piston deposits, for example high-temperature varnish and lacquer deposits, in engines; it normally has acid-neutralising properties and is capable of keeping finely divided solids in suspension. Most detergents are based on metal "soaps"; that is metal salts of acidic organic compounds, sometimes referred to as surfactants.

Detergents generally comprise a polar head with a long hydrophobic tail, the polar head comprising a metal salt of an acidic organic compound. Large amounts of a metal base can be included by reacting an excess of a metal base, such as an oxide or hydroxide, with an acidic gas such as carbon dioxide to give an overbased detergent which comprises neutralised detergent as the outer layer of a metal base (e.g. carbonate) micelle.

The surfactant of the present invention is a hydrocarbyl substituted hydroxybenzoic acid, preferably a hydrocarbyl-substituted salicylic acid. Hydrocarbyl includes alkyl or alkenyl. The overbased metal hydrocarbyl-substituted hydroxybenzoate typically has the structure shown:

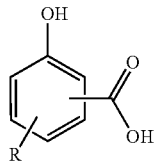

wherein R is a linear or branched aliphatic group, preferably a hydrocarbyl group, and more preferably an alkyl group, including branched- or most preferably straight-chain alkyl groups. There may be more than one R group attached to the benzene ring. M is an alkali (e.g. lithium, sodium or potassium) or alkaline earth metal (e.g. calcium, magnesium barium or strontium). Calcium or magnesium is preferred; calcium is especially preferred. The COOM group can be in the ortho, meta or para position with respect to the hydroxyl group; the ortho position is preferred. The R group can be in the ortho, meta or para position with respect to the hydroxyl group.

Hydroxybenzoic acids are typically prepared by the carboxylation, by the Kolbe-Schmitt process, of phenoxides, and in that case, will generally be obtained (normally in a diluent) in admixture with uncarboxylated phenol. Hydroxybenzoic acids may be non-sulphurized or sulphurized, and may be chemically modified and/or contain additional substituents. Processes for sulphurizing a hydrocarbyl-substituted hydroxybenzoic acid are well known to those skilled in the art, and are described, for example, in US 2007/0027057.

In hydrocarbyl-substituted hydroxybenzoic acids, the hydrocarbyl group is preferably alkyl (including branched- or more preferably straight-chain alkyl groups), and the alkyl groups advantageously contain 5 to 100, preferably 9 to 30, especially 14 to 24, carbon atoms.

The term "overbased" is generally used to describe metal detergents in which the ratio of the number of equivalents of the metal moiety to the number of equivalents of the acid moiety is greater than one. The term 'low-based' is used to describe metal detergents in which the equivalent ratio of metal moiety to acid moiety is greater than 1, and up to about 2. The metal hydroxybenzoate of the present invention is low-based or neutral.

By an "overbased calcium salt of surfactants" is meant an overbased detergent in which the metal cations of the oil-insoluble metal salt are essentially calcium cations. Small amounts of other cations may be present in the oil-insoluble metal salt, but typically at least 80, more typically at least 90, for example at least 95, mole %, of the cations in the oil-insoluble metal salt, are calcium ions. Cations other than calcium may be derived, for example, from the use in the manufacture of the overbased detergent of a surfactant salt in which the cation is a metal other than calcium. Preferably, the metal salt of the surfactant is also calcium.

Carbonated overbased metal detergents typically comprise amorphous nanoparticles. Additionally, there are disclosures of nanoparticulate materials comprising carbonate in the crystalline calcite and vaterite forms.

The basicity of the detergents is preferably expressed as a total base number (TBN). A total base number is the amount of acid needed to neutralize all of the basicity of the overbased material. The TBN may be measured using ASTM standard D2896 or an equivalent procedure. The detergent may have a low TBN (i.e. a TBN of less than 50), a medium TBN (i.e. a TBN of 50 to 150) or a high TBN (i.e. a TBN of greater than 150, such as 150-500). Preferred detergents according to the invention have a TBN of up to 150.

In general, neutral metal hydrocarbyl-substituted hydroxybenzoates can be prepared by neutralisation of hydrocarbyl-substituted hydroxybenzoic acid with an equivalent quantity of metallic base. However, a preferred method of preparing a neutral calcium salt of hydroxybenzoic acid is through double decomposition of methanolic solutions of calcium chloride and sodium hydroxide in the presence of hydrocarbyl-substituted hydroxybenzoic acid, followed by removal of solids and process solvents.

Overbased metal hydrocarbyl-substituted hydroxybenzoates can be prepared by any of the techniques employed in the art. A general method is as follows:

1. Neutralisation of hydrocarbyl-substituted hydroxybenzoic acid with molar excess of metallic base to produce a slightly overbased metal hydrocarbyl-substituted hydroxybenzoate complex, in a solvent mixture consisting of a volatile hydrocarbon, an alcohol and water;
2. Optionally, carbonation to produce colloidally dispersed metal carbonate followed by post-reaction period;
3. Removal of residual solids that are not colloidally dispersed; and
4. Stripping to remove process solvents.

Overbased metal hydrocarbyl-substituted hydroxybenzoates can be made by either a batch or a continuous overbasing process.

To obtain a neutral or overbased metal hydrocarbyl-substituted hydroxybenzoate detergent having a basicity index of less than 2, the quantity of metallic base is restricted to no more than 2 equivalents per equivalent of acid, and/or, if desired, the quantity of carbon dioxide is restricted to no more than 0.5 equivalents per equivalent of acid. Preferably, the quantity of metallic base is restricted to no more than 1.5 equivalents per equivalent of acid, and/or, if desired, the quantity of carbon dioxide is restricted to no more than 0.2 equivalents per equivalent of acid. More preferably, the quantity of metallic base is restricted to no more than 1.2 equivalents per equivalent of acid.

Alternatively, an excess of both metallic base and carbon dioxide can be used, provided that unreacted solids are removed before the carbonation step. In this case the basicity index will not exceed about 1.5. If an overbased metal hydrocarbyl-substituted hydroxybenzoate detergent having a basicity index of less than 1.5 is required, it is not essential to use any carbon dioxide, but it is preferred. However, most preferably the metal hydrocarbyl-substituted hydroxybenzoate detergent is neutral and not overbased.

As carbonation proceeds, dissolved hydroxide is converted into colloidal carbonate particles dispersed in the mixture of volatile hydrocarbon solvent and non-volatile hydrocarbon oil.

Carbonation may by carried out over a range of temperatures up to the reflux temperature of the alcohol promoters.

The volatile hydrocarbon solvent of the reaction mixture is preferably a normally liquid aromatic hydrocarbon having a boiling point not greater than about 150° C. Aromatic hydrocarbons have been found to offer certain benefits, e.g. improved filtration rates, and examples of suitable solvents are toluene, xylene, and ethyl benzene.

The alkanol is preferably methanol although other alcohols such as ethanol can be used. Correct choice of the ratio of alkanol to hydrocarbon solvents, and the water content of the initial reaction mixture, are important to obtain the desired product.

Oil may be added to the reaction mixture; if so, suitable oils include hydrocarbon oils, particularly those of mineral origin. Oils which have viscosities of 15 to 30 cSt at 38° C. are very suitable.

After the reaction with metallic base, the reaction mixture is typically heated to an elevated temperature, e.g. above 130° C., to remove volatile materials (water and any remaining alkanol and hydrocarbon solvent). When the synthesis is complete, the raw product is hazy as a result of the presence of suspended sediments. It is clarified by, for example, filtration or centrifugation. These measures may be used before, or at an intermediate point, or after carbonation and solvent removal.

The products are generally used as an oil solution. If there is insufficient oil present in the reaction mixture to retain an oil solution after removal of the volatiles, further oil should be added. This may occur before, or at an intermediate point, or after solvent removal.

Additional materials may form an integral part of an overbased metal detergent. These may, for example, include long chain aliphatic mono- or di-carboxylic acids. Suitable carboxylic acids included stearic and oleic acids, and polyisobutylene (PIB) succinic acids.

The lubricating oil composition may include at least one other additive selected from friction modifiers, antiwear agents, dispersants, oxidation inhibitors, viscosity modifiers, pour point depressants, rust inhibitors, corrosion inhibitors, demulsifying components and foam control agents.

Friction Modifiers

Friction modifiers include glyceryl monoesters of higher fatty acids, for example, glyceryl mono-oleate; esters of long chain polycarboxylic acids with diols, for example, the butane diol ester of a dimerized unsaturated fatty acid; oxazoline compounds; and alkoxylated alkyl-substituted monoamines, diamines and alkyl ether amines, for example, ethoxylated tallow amine and ethoxylated tallow ether amine.

Other known friction modifiers comprise oil-soluble organo-molybdenum compounds. Such organo-molybdenum friction modifiers also provide antioxidant and antiwear credits to a lubricating oil composition. As an example of such oil-soluble organo-molybdenum compounds, there may be mentioned the dithiocarbamates, dithiophosphates, dithiophosphinates, xanthates, thioxan hates, sulphides, and the like, and mixtures thereof. Particularly preferred are molybdenum dithiocarbamates, dialkyldithiophosphates, alkyl xanthates and alkylthioxanthates.

Additionally, the molybdenum compound may be an acidic molybdenum compound. These compounds will react with a basic nitrogen compound as measured by ASTM test D-664 or D-2896 titration procedure and are typically hexavalent. Included are molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds.

The molybdenum compounds may be of the formula $Mo(ROCS_2)_4$ and $Mo(RSCS_2)_4$ wherein R is an organo group selected from the group consisting of alkyl, aryl, aralkyl and alkoxyalkyl, generally of from 1 to 30 carbon atoms, and preferably 2 to 12 carbon atoms and most preferably alkyl of 2 to 12 carbon atoms. Especially preferred are the dialkyldithiocarbamates of molybdenum.

Another group of organo-molybdenum compounds are trinuclear molybdenum compounds, especially those of the formula $Mo_3S_kL_nQ_z$ and mixtures thereof wherein the L are independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms should be present among all the ligands' organo groups, such as at least 25, at least 30, or at least 35 carbon atoms.

The ligands are independently selected from the group of

1 —X—R,

2 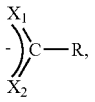

3 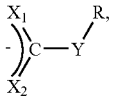

4 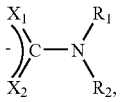

5 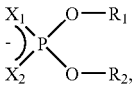

and mixtures thereof, wherein X, $X_1$, $X_2$, and Y are independently selected from the group of oxygen and sulphur, and wherein $R_1$, $R_2$, and R are independently selected from hydrogen and organo groups that may be the same or different. Preferably, the organo groups are hydrocarbyl groups such as alkyl (e.g., in which the carbon atom attached to the remainder of the ligand is primary or secondary), aryl, substituted aryl and ether groups. More preferably, each ligand has the same hydrocarbyl group.

The term "hydrocarbyl" denotes a substituent having cart on atoms directly attached to the remainder of the ligand and is predominantly hydrocarbyl in character within the context of this invention. Such substituents include the following:

1. Hydrocarbon substituents, that is, aliphatic (for example alkyl or alkenyl), alicyclic (for example cycloalkyl or cycloalkenyl) substituents, aromatic-, aliphatic- and alicyclic-substituted aromatic nuclei and the like, as well as cyclic substituents wherein the ring is completed through another portion of the ligand (that is, any two indicated substituents may together form an alicyclic group).
2. Substituted hydrocarbon substituents, that is, those containing non-hydrocarbon groups which, in the context of this invention, do not alter the predominantly hydrocarbyl character of the substituent. Those skilled in the art will be aware of suitable groups (e.g., halo, especially chloro and fluoro, amino, alkoxyl, mercapto, alkylmercapto, nitro, nitroso, sulphoxy, etc.).
3. Hetero substituents, that is, substituents which, while predominantly hydrocarbon in character within the context of this invention, contain atoms other than carbon present in a chain or ring otherwise composed of carbon atoms.

Importantly, the organo groups of the ligands have a sufficient number of carbon atoms to render the compound soluble or dispersible in the oil. For example, the number of carbon atoms in each group will generally range between about 1 to about 100, preferably from about 1 to about 30, and more preferably between about 4 to about 20. Preferred ligands include dialkyldithiophosphate, alkylxanthate, and dialkyldithiocarbamate, and of these dialkyldithiocarbamate is more preferred. Organic ligands containing two or more of the above functionalities are also capable of serving as ligands and binding to one or more of the cores. Those skilled in the art will realize that formation of the compounds requires selection of ligands having the appropriate charge to balance the core's charge.

Compounds having the formula $Mo_3S_kL_nQ_z$ have cationic cores surrounded by anionic ligands and are represented by structures such as

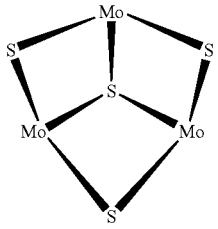

and

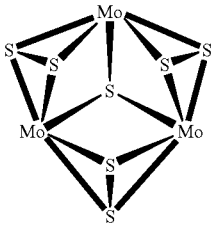

and have net charges of +4. Consequently, in order to solubilize these cores the total charge among all the ligands must be −4. Four monoanionic ligands are preferred. Without wishing to be bound by any theory, it is believed that two or more trinuclear cores may be bound or interconnected by means of one or more ligands and the ligands may be multidentate. This includes the case of a multidentate ligand having multiple connections to a single core. It is believed that oxygen and/or selenium may be substituted for sulphur in the core(s).

Oil-soluble or dispersible trinuclear molybdenum compounds can be prepared by reacting in the appropriate liquid(s)/solvent(s) a molybdenum source such as $(NH_4)_2Mo_3S_{13}.n(H_2O)$, where n varies between 0 and 2 and includes non-stoichiometric values, with a suitable ligand source such as a tetralkylthiuram disulphide. Other oil-soluble or dispersible trinuclear molybdenum compounds can be formed during a reaction in the appropriate solvent(s) of a molybdenum source such as of $(NH_4)_2Mo_3S_{13}.n(H_2O)$, a ligand source such as tetralkylthiuram disulphide, dialkyldithiocarbamate, or dialkyldithiophosphate, and a sulphur abstracting agent such cyanide ions, sulphite ions, or substituted phosphines. A tentatively, a trinuclear molybdenum-sulphur halide salt such as $[M']_2[Mo_3S_7A_6]$, where M' is a counter ion, and A is a halogen such as Cl, Br, or I, may be reacted with a ligand source such as a dialkyldithiocarbamate or dialkyldithiophosphate in the appropriate liquid(s)/solvent(s) to form an oil-soluble or dispersible trinuclear molybdenum compound. The appropriate liquid/solvent may be, for example, aqueous or organic.

A compound's oil solubility or dispersibility may be influenced by the number of carbon atoms in the ligand's organo groups. At least 21 total carbon atoms should be present among all the ligand's organo groups. Preferably, the ligand source chosen has a sufficient number of carbon atoms in its organo groups to render the compound soluble or dispersible in the lubricating composition.

The terms "oil-soluble" or "dispersible" used herein do not necessarily indicate that the compounds or additives are soluble, dissolvable, misicible, or capable of being suspended in the oil in all proportions. These do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

The molybdenum compound is preferably an organo-molybdenum compound. Moreover, the molybdenum compound is preferably selected from the group consisting of a molybdenum dithiocarbamate (MoDTC), molybdenum dithiophosphate, molybdenum dithiophosphinate, molybdenum xanthate, molybdenum thioxanthate, molybdenum sulphide and mixtures thereof. Most preferably, the molybdenum compound is present as molybdenum dithiocarbamate. The molybdenum compound may also be a trinuclear molybdenum compound.

Dihydrocarbyl Dithiophosphate Metal Salts

Dihydrocarbyl dithiophosphate metal salts are frequently used as antiwear and antioxidant agents. The metal may be an alkali or alkaline earth metal, or aluminum, lead, tin, molybdenum, manganese, nickel or copper. The zinc salts are most commonly used in lubricating oils in amounts of 0.1 to 10, preferably 0.2 to 2 wt. %, based upon the total weight of the lubricating oil composition. They may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt, any basic or neutral zinc compound could be used but the oxides, hydroxides and carbonates are most generally employed. Commercial additives frequently contain an excess of zinc due to the use of an excess of the basic zinc compound in the neutralization reaction.

The preferred zinc dihydrocarbyl dithiophosphates are oil soluble salts of dihydrocarbyl dithiophosphoric acids and may be represented by the following formula:

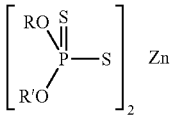

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. R and R') in the dithiophosphoric acid will generally be about 5 or greater. The zinc dihydrocarbyl dithiophosphate can therefore comprise zinc dialkyl dithiophosphates. The present invention may be particularly useful when used with lubricant compositions containing phosphorus levels of from about 0.02 to about 0.12 wt. %, preferably from about 0.03 to about 0.10 wt. %. More preferably, the phosphorous level of the lubricating oil composition will be less than about 0.08 wt. %, such as from about 0.05 to about 0.08 wt. %.

Ashless Dispersants

Ashless dispersants maintain in suspension oil insolubles resulting from oxidation of the oil during wear or combustion. They are particularly advantageous for preventing the precipitation of sludge and the formation of varnish, particularly in gasoline engines. Ashless dispersants comprise an oil soluble polymeric hydrocarbon backbone bearing one or more functional groups that are capable of associating with particles to be dispersed. Typically, the polymer backbone is functionalized by amine, alcohol, amide, or ester polar moieties, often via a bridging group. The ashless dispersant may be, for example, selected from oil soluble salts, esters, aminoesters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and polyalkylene polyamine.

The oil soluble polymeric hydrocarbon backbone of those dispersants is typically derived from an olefin polymer or polyene, especially polymers comprising a major molar amount (i.e., greater than 50 mole %) of a $C_2$ to $C_{18}$ olefin (e.g., ethylene, propylene, butylene, isobutylene, pentene, octene-1, styrene), and typically a $C_2$ to $C_5$ olefin. The oil soluble polymeric hydrocarbon backbone may be a homopolymer (e.g., polypropylene or polyisobutylene) or a copolymer of two or more of such olefins (e.g., copolymers of ethylene and an alpha-olefin such as propylene or butylene, or copolymers of two different alpha-olefins). Other copolymers include those in which a minor molar amount of the copolymer monomers, for example, 1 to 10 mole %, is a non-conjugated diene, such as a $C_3$ to $C_{22}$ non-conjugated diolefin (for example, a copolymer of isobutylene and butadiene, or a copolymer of ethylene, propylene and 1,4-hexadiene or 5-ethylidene-2-norbornene). Preferred are polyisobutenyl (Mn 400-2500, preferably 950-2200) succinimide dispersants. Preferably, heavy duty diesel (HDD) engine lubricating oil compositions of the present invention contain an amount of a nitrogen-containing dispersant introducing from at out 0.08 to about 0.25 mass %, preferably from about 0.09 to about 0.18 mass %, more preferably from about 0.10 to about 0.13 mass %, of nitrogen into the composition.

Oxidation Inhibitors

Oxidation inhibitors or antioxidants reduce the tendency of mineral oils to deteriorate in service. Oxidative deterioration can be evidenced by sludge in the lubricant, varnish-like deposits on the metal surfaces, and by viscosity growth. Such oxidation inhibitors include hindered phenols, alkaline earth metal salts of alkylphenolthioesters having preferably $C_5$ to $C_{12}$ alkyl side chains, alkylphenol sulphides, oil soluble phenates and sulphurized phenates, phosphosulphurized or sulphurized hydrocarbons or esters, phosphorous esters, metal thiocarbamates, oil soluble copper compounds as described in U.S. Pat. No. 4,867,890, and molybdenum-containing compounds.

Phosphorus-free supplemental oxidation inhibitors, other than the previously described hindered phenol antioxidants, suitable for use in the present invention include alkaline earth metal salts of alkylphenolthioesters having preferably $C_5$ to $C_{12}$ alkyl side chains, calcium nonylphenol sulfide, ashless oil soluble phenates and sulfurized phenates and phosphosulfurized or sulfurized hydrocarbons.

Aromatic amines having at least two aromatic groups attached directly to the nitrogen constitute another class of compounds that is frequently used for antioxidancy. They are preferably used in only small amounts, i.e., up to 0.4 wt. %, or more preferably avoided altogether other than such amount as may result as an impurity from another component of the composition.

Typical oil soluble aromatic amines having at least two aromatic groups attached directly to one amine nitrogen contain from 6 to 16 carbon atoms. The amines may contain more than two aromatic groups. Compounds having a total of at least three aromatic groups in which two aromatic groups are linked by a covalent bond or by an atom or group (e.g., an oxygen or sulphur atom, or a —CO—, —$SO_2$— or alkylene group) and two are directly attached to one amine nitrogen also considered aromatic amines having at least two aromatic groups attached directly to the nitrogen. The aromatic rings are typically substituted by one or more substituents selected from alkyl, cycloalkyl, alkoxy, aryloxy, acyl, acylamino, hydroxy, and nitro groups. The amount of any such oil-soluble aromatic amines having at least two aromatic groups attached directly to one amine nitrogen should preferably not exceed 0.4 wt. % active ingredient.

Viscosity Modifiers

Viscosity modifiers (VM) function to impart high and low temperature operability to a lubricating oil. The VM used may have that sole function, or may be multifunctional. Representative examples of suitable viscosity modifiers are polyisobutylene, copolymers of ethylene and propylene, polymethacrylates, methacrylate copolymers, copolymers of an unsaturated dicarboxylic acid and a vinyl compound, interpolymers of styrene and acrylic esters, and partially hydrogenated copolymers of styrene/isoprene, styrene/butadiene, and isoprene/butadiene, as well as the partially hydrogenated homopolymers of butadiene and isoprene. Multifunctional viscosity modifiers that further function as dispersants are also known.

A viscosity index improver dispersant functions both as a viscosity index improver and as a dispersant. Examples of viscosity index improver dispersants include reaction products of amines, for example polyamines, with a hydrocarbyl-substituted mono- or dicarboxylic acid in which the hydrocarbyl substituent comprises a chain of sufficient length to impart viscosity index improving properties to the compounds. In general, the viscosity index improver dispersant may be, for example, a polymer of a $C_4$ to $C_{24}$ unsaturated ester of vinyl alcohol or a $C_3$ to $C_{10}$ unsaturated mono-carboxylic acid or a $C_4$ to $C_{10}$ di-carboxylic acid with an unsaturated nitrogen-containing monomer having 4 to 20 carbon atoms; a polymer of a $C_2$ to $C_{20}$ olefin with an unsaturated $C_3$ to $C_{10}$ mono- or di-carboxylic acid neutralised with an amine, hydroxyamine or an alcohol; or a polymer of ethylene with a $C_3$ to $C_{20}$ olefin further reacted either by grafting a $C_4$ to $C_{20}$ unsaturated nitrogen-containing monomer thereon or by grafting an unsaturated acid onto the polymer backbone and then reacting carboxylic acid groups of the grafted acid with an amine, hydroxy amine or alcohol.

Pour Point Depressants

Pour point depressants, otherwise known as lube oil flow improvers (LOFT), lower the minimum temperature at which the fluid will flow or can be poured. Such additives are well known. Typical of those additives that improve the low temperature fluidity of the fluid are $C_8$ to $C_{18}$ dialkyl fumarate/vinyl acetate copolymers, and polymethacrylates.

Rust Inhibitors

Rust inhibitors selected from the group consisting of non-ionic polyoxyalkylene polyols and esters thereof, polyoxyalkylene phenols, and anionic alkyl sulfonic acids may be used.

Corrosion Inhibitors

Copper and lead bearing corrosion inhibitors may be used, but are typically not required with the formulation of the present invention. Typically such compounds are the thiadiazole polysulfides containing from 5 to 50 carbon atoms, their derivatives and polymers thereof. Derivatives of 1,3,4 thiadiazoles such as those described in U.S. Pat. Nos. 2,719,125; 2,719,126; and 3,087,932; are typical. Other similar materials are described in U.S. Pat. Nos. 3,821,236; 3,904,537; 4,097,387; 4,107,059; 4,136,043; 4,188,299; and 4,193,882. Other additives are the thio and polythio sulfanamides of thiadiazoles such as those described in UK Patent Specification No. 1,560,830. Benzotriazoles derivative) also fall within this class of additives. When these compounds are included in the lubricating composition, they are preferably present in an amount not exceeding 0.2 mass % active ingredient.

Demulsifying Component

A small amount of a demulsifying component may be used. A preferred demulsifying component is described in EP 330,522. It is obtained by reacting an alkylene oxide with an adduct obtained by reacting a bis-epoxide with u polyhydric alcohol. The demulsifier should be used at a level not exceeding 0.1 mass % active ingredient. A treat rate of 0.001 to 0.05 mass % active ingredient is convenient.

Foam Control

Foam control can be provided by many compounds including an antifoamant of the polysiloxane type, for example, silicone oil or polydimethyl siloxane.

It may be necessary to include an additive which maintains the stability of the viscosity of the blend. Thus, although polar group-containing additives achieve a suitably low viscosity in the pre-blending stage it has been observed that some compositions increase in viscosity when stored for prolonged periods. Additives which are effective in controlling this viscosity increase include the long chain hydrocarbons functionalized by reaction with mono- or dicarboxylic acids or anhydrides which are used in the preparation of the ashless dispersants as hereinbefore disclosed.

It is not unusual to add an additive to a lubricating oil, or additive concentrate, in a diluent, such that only a portion of the added weight represents an active ingredient (A.I.). For example, dispersant may be added together with an equal weight of diluent in which case the "additive" is 50% A.I. dispersant. On the other hand, detergents are conventionally formed in diluent to provide a specified TBN and are oftentimes not referred to on an A.I. basis. As used herein, the term miss percent (mass %), when applied to a detergent refers to the total amount of detergent and diluent unless otherwise indicated, and when applied to all other additive refers to the weight of active ingredient unless otherwise indicated.

The individual additives may be incorporated into a base stock in any convenient way. Thus, each of the components can be added directly to the base stock or base oil blend by dispersing or dissolving it in the base stock or base oil blend at the desired level of concentration. Such blending may occur at ambient temperature or at an elevated temperature. When lubricating compositions contain one or more of the above-mentioned additives, each additive is typically blended into the base oil in an amount that enables the additive to provide its desired function. Representative amounts of such additives, used in crankcase lubricants, are listed below. All the values listed are stated as mass percent active ingredient.

| ADDITIVE | MASS % (Broad) | MASS % (Preferred) |
|---|---|---|
| Ashless Dispersant | 0.1-20 | 1-8 |
| Metal Detergents | 0.1-6 | 0.2-4 |
| Corrosion Inhibitor | 0-5 | 0-1.5 |
| Metal Dihydrocarbyl Dithiophosphate | 0.1-6 | 0.1-4 |
| Antioxidant | 0-5 | 0.01-1.5 |
| Pour Point Depressant | 0.01-5 | 0.01-1.5 |
| Antifoaming Agent | 0-5 | 0.001-0.15 |
| Supplemental Antiwear Agents | 0-0.5 | 0-0.2 |
| Friction Modifier | 0-5 | 0-1.5 |
| Viscosity Modifier | 0-6 | 0.01-4 |
| Basestock | Balance | Balance |

Preferably, all the additives except for the viscosity modifier and the pour point depressant are blended into a concentrate or additive package described herein as the additive package that is subsequently blended into base stock to make the finished lubricant. The concentrate will typically be formulated to contain the additive(s) in proper amounts to provide the desired concentration in the final formulation when the concentrate is combined with a predetermined amount of a base lubricant.

The concentrate is preferably made in accordance with the method described in U.S. Pat. No. 4,938,880. That patent describes making a pre-mix of ashless dispersant and metal detergents that is pre-blended at a temperature of at least about 100° C. Thereafter, the pre-mix is cooled to at least 85° C. and the additional components are added.

Crankcase Lubricating Oil Formulation

A crankcase lubricating oil formulation may employ from 2 to 25 mass %, preferably 4 to 20 mass %, and most preferably about 5 to 18 mass % of the concentrate or additive package with the remainder being base stock. Preferably the volatility of the final crankcase lubricating oil formulation, as measured by the Noack volatility test (ASTM D5880), is less than or equal to 15 mass %, preferably less than or equal to 13 mass %, more preferably less than or equal to 12 mass %, most preferably less than or equal to 10 mass %. Preferably, lubricating oil compositions of the present invention have a compositional TBN (using ASTM D4739) of less than about 10.5, such as between 7.5 and 10.5, preferably less than or equal to about 9.5, such as about 8.0 to about 9.5.

Marine Cylinder Lubricants

A marine cylinder lubricating oil formulation may employ from 10 to 35 mass %, preferably 13 to 30 mass %, and most preferably about 16 to 24 mass % of the concentrate or additive package with the remainder being base stock. Preferably, marine cylinder lubricating oil compositions have a con positional TBN (using ASTM D2896) of about 40 to 100, such as between 50 and 90.

Trunk Piston Engine Oils

A trunk piston engine oils may employ from 7 to 35 mass %, preferably 10 to 28 mass %, and most preferably about 12 to 24 mass % of the concentrate or additive package with the remainder being base stock. Preferably, the trunk piston engine oils have a compositional TBN (using ASTM D2896) of about 20 to 60, such as between 25 and 55.

Lubricating Oils

The lubricating oil includes a Group II basestock. The definition for a Group II basestock can be found the American Petroleum Institute (API) publication "Engine Oil Licensing and Certification System", Industry Services Department, Fourteenth Edition, December 1996, Addendum 1, December 1998. Said publication categorizes Group II base stocks as containing greater than or equal to 90 percent saturates and less than or equal to 0.03 percent sulphur and have a viscosity index greater than or equal to 80 and less than 120 using the test methods specified in the Table below.

Analytical Methods for Base Stock

| Property | Test Method |
|---|---|
| Saturates | ASTM D 2007 |
| Viscosity Index | ASTM D 2270 |
| Sulphur | ASTM D 2622 |
| | ASTM D 4294 |
| | ASTM D 4927 |
| | ASTM D 3120 |

The present invention is illustrated by but in no way limited to the following examples.

EXAMPLES

The following neutral and overbased metal salicylate detergents were tested:

| Examples | Basicity Index |
|---|---|
| Example 1 | 1.0 |
| Example 2 | 1.4 |
| Comparative Example 3 | 3.0 |
| Comparative Example 4 | 7.8 |

Methods for the synthesis of alkylsalicylic acid, and the formation of overbased detergents derived therefrom, are well known to those skilled in the art. For example, such methods are described in US 2007/0027043 and references cited therein. The alkylsalicylic acid used in these Examples was made from C14-C18 linear alpha-olefins, such as those marketed by Shell Chemicals under the name SHOP. It contained approximately 10% moles of unconverted alkylphenol, and had an acid content of 2.62 meq./g.

The metal salicylate detergents were obtained as follows.

Preparation of Neutral Calcium Salicylate

Example 1

| Initial Flask Charges | | Charge (g) |
|---|---|---|
| | Alkylsalicylic acid | 500 |
| | Xylene | 500 |
| Additions | | |
| Funnel 1 | $CaCl_2$ | 64.2 |
| | Methanol | 327 |
| Funnel 2 | NaOH | 46.3 |
| | Methanol | 327 |

Method:

Preparation of Funnel 1:

The methanol was weighed into a 1 liter conical flask. The $CaCl_2$ was weighed out and was then added slowly to the methanol at ambient temperature with brisk stirring. Once the $CaCl_2$ had dissolved, it was transferred to a 500 ml addition funnel.

Preparation of Funnel 2:

This was done in the same manner as Funnel 1, but with NaOH instead of $CaCl_2$.

Reaction:

The alkylsalicylic acid and xylene were weighed into 2 liter baffled flask fitted with a stirrer. This was placed in a mantle and set up for reflux. Stirring was started at 220 rpm and the two addition funnels were placed in ports on the reaction vessel lid. The NaOH and $CaCl_2$ solutions were run into the vessel simultaneously at approximately the same rate. Addition took place over a period of 40 minutes; the two solutions were added at a fast drip. During the addition the stirring was increased to 300 rpm to gain better phase mixing. The reaction was not heated and was carried out at ambient temperature; start temperature was 20.5° C. An exotherm was observed during the reaction and temperature at the end of addition was 29.4° C.

Once addition had finished, the funnels were removed and a 10 ml Dean and Stark trap was fitted. A blanket of 300 ml $min^{-1}$ nitrogen was passed over the mixture and the temperature was ramped to 140° C. over 90 min, and then held at reflux for 1 hour. During this time no water was observed in the Dean and Stark.

After 1 hour, the reaction vessel was cooled. Once below 60° C. the mixture was decanted into two centrifuge cans and centrifuged for 30 minutes at 2500 rpm to remove the precipitate. After centrifugation, the mixture was decanted into a 2 liter beaker and was bled into a rotary evaporator at 125° C. The product was stripped as fully as possible.

Preparation of Low Base Calcium Salicylate

Example 2

Charges

| | Charge (g) |
|---|---|
| Alkylsalicylic acid | 290 |
| Xylene | 1321 |
| $Ca(OH)_2$ | 37.6 |
| Methanol | 100 |
| Distilled water | 3 |
| Base oil SN 150 | 175 |

Method:

Alkylsalicylic acid and xylene were mixed together and heated to 60° C. over 20 minutes. Lime was added and stirred while the temper* cure was held at 60° C. for one hour. Methanol and water were added and stirred at 60° C. for a further 20 minutes. Carbon dioxide was added at 0.73 l/min at 60° C., and then the reaction mixture was left stirring for five minutes.

The mixture was centrifuged for 30 minutes at 1800 rpm. The methanol formed a layer on the surface which was removed. The bulk liquid was transferred to a rotary evaporator, to which base oil was added. The xylene, and any residual methanol and water, were stripped off at 125° C. for two hours.

Comparative Example 3 is a commercial product, available from Infineum under the trade name Infineum M7101.

Comparative Example 4 is a commercial product, available from Infineum under the trade name Infineum M7125.

Comparative Examples 3 and 4 were prepared by mixing together xylene and the same alkylsalicylic acid as in Example 2 and heating them at 60° C. Lime was added and stirred while the temperature was held at 60° C. Methanol and water were added and stirred at 60° C. Carbon dioxide was added at 60° C. and then the reaction mixture was left stirring. The mixture was centrifuged. Base oil was added and the xylene, and any residual methanol and water, were stripped off at 125° C.

Focused Beam Reflectance Method ('FBRM)

The metal salicylate detergents were tested for their asphaltene dispersancy using laser light scattering according to the Focused Beam Reflectance method ('FBRM'), which predicts asphaltene agglomeration and hence 'black sludge' formation. The FBRM test method was disclosed at the $7^{th}$ International Symposium on Marine Engineering, Tokyo, 24-28 Oct. 2005, and was published in 'The Benefits of Salicylate Detergents in TPEO Applications with a Variety of Base Stocks', in the Conference Proceedings. Further details were disclosed at the CIMAC Congress, Vienna, 21-24 May 2007 and published in "Meeting the Challenge of New Base Fluids for the Lubrication of Medium Speed Marine Engines—An Additive Approach" in the Congress Proceedings. In the latter paper it is disclosed that by using the FBRM method it is possible to obtain quantitative results for asphaltene dispersancy that predict performance for lubricant systems based on both Group I and Group II base stocks. The predictions of relative performance obtained from FBRM were confirmed by engine tests in marine diesel engines.

The FBRM probe contains fibre optic cables through which laser light travels to reach the probe tip. At the tip an optic focuses the laser light to a small spot. The optic is rotated so that the focussed beam scans a circular path between the window of the probe and the sample. As particles flow past the window they intersect the scanning path, giving backscattered light from the individual particles.

The scanning laser beam travels much faster than the particles; this means that the particles are effectively stationary. As the focussed beam reaches one edge of the particle there is an increase in the amount of backscattered light; the amount will decrease when the focussed beam reaches the other edge of the particle.

The instrument measures the time of the increased backscatter. The time period of backscatter from one particle is multiplied by the scan speed and the result is a distance or chord length. A chord length is a straight line between any two points on the edge of a particle. This is represented as a chord length distribution, a graph of numbers of chord lengths (particles) measured as a function of the chord length dimensions in microns. As the measurements are performed in real time the statistics of a distribution can be calculated and tracked. FBRM typically measures tens of thousands of chords per second, resulting in a robust number-by-chord length distribution. The method gives an absolute measure of the particle size distribution of the asphaltene particles.

The Focused beam Reflectance Probe (FBRM), model Lasentec D600L, was supplied by Mettler Toledo, Leicester, UK. The instrument was used in a configuration to give a particle size resolution of 1 μm to 1 mm. Data from FBRM can be presented in several ways. Studies have suggested that the average counts per second can be used as a quantitative determination of asphaltene dispersancy. This value is a function of both the average size and level of agglomerate. In this application, the average count rate (over the entire size range) was monitored using a measurement time of 1 second per sample.

Neutral or overbased detergent (10% w/w) and base oil were blended together for fifteen minutes whilst heating to 60° C. and stirring at 400 rpm; when the temperature reached 60° C. the FBRM probe was inserted into the sample and measurements made for 15 minutes. An aliquot of heavy fuel oil (10% w/w) was introduced into the lubricant formulation under stirring using a four blade stirrer (at 400 rpm). A value for the average counts per second was taken when the count rate had reached an equilibrium value (typically after 1 hour).

The metal salicylate detergents were tested in Chevron 600 RLOP Group II base stock.

FBRM Test Results

| Example | Base Stock | Basicity Index | Particle Counts, per s |
|---|---|---|---|
| 1 | Chevron 600 RLOP | 1.0 | 30 |
| 2 | Chevron 600 RLOP | 1.3 | 215 |
| Comparative Example 3 | Chevron 600 RLOP | 3.0 | 1796 |
| Comparative Example 4 | Chevron 600 RLOP | 7.8 | 3288 |

As shown in the Table above, the neutral or overbased metal salicylate detergents having a basicity index of less than 2.0 exhibit surprisingly lower average counts per second. This value is a function of both the average size and the level of agglomerate. Therefore, the use of a neutral or overbased metal salicylate detergent having a basicity index of less than 2.0 improves asphaltene dispersancy in Group II basestocks.

What is claimed is:

1. A method of reducing asphaltene precipitation or 'black paint' formation in operation of a marine diesel trunk piston engine fuelled with a heavy fuel oil and lubricated with a lubricating oil composition having a compositional TBN of from about 20 to about 60 mg KOH/g and comprising a Group II basestock, the method including a step of adding metal hydrocarbyl substituted alkylsalycilate detergent wherein the hydrocarbyl group is a straight-chain alkyl group having 14 to 24 carbon atoms, having a bacisity index of not less than 1.0 and less than 1.5 to the Group II basestock.

2. The method as claimed in claim 1, wherein the metal in the metal hydrocarbyl substituted alkylsalycilate detergent is calcium.

* * * * *